United States Patent [19]

Roberts, Jr. et al.

[11] 4,064,821

[45] Dec. 27, 1977

[54] VARIABLE CAMBER WING SAIL

[76] Inventors: William C. Roberts, Jr., 1442 39th St., West Palm Beach, Fla. 33407; Stephen Edmonds, 1160 Coral Way, Riviera Beach, Fla. 33404

[21] Appl. No.: 744,031

[22] Filed: Nov. 22, 1976

[51] Int. Cl.[2] ..... B63H 9/06

[52] U.S. Cl. ..... 114/103; 114/39; 114/90; 114/102

[58] Field of Search ..... 114/39, 90, 91, 97, 114/98, 102, 103; 244/DIG. 1, 35 R, 44, 219

[56] References Cited

U.S. PATENT DOCUMENTS

| | | | |
|---|---|---|---|
| 1,613,890 | 1/1927 | Herreshoff | 114/90 |
| 2,561,253 | 7/1951 | Wells-Coates | 114/103 |
| 3,580,203 | 5/1971 | Martin | 114/102 |

FOREIGN PATENT DOCUMENTS

| | | | |
|---|---|---|---|
| 2,001,405 | 9/1971 | Germany | 114/102 |
| 1,927,541 | 2/1971 | Germany | 114/103 |

*Primary Examiner*—Trygve M. Blix
*Assistant Examiner*—Charles E. Frankfort

[57] ABSTRACT

The present invention pertains to an apparatus to improve the efficiency and performance of an aerodynamic lift structure for use on sailing devices. A two-sided, spaced apart sail structure is provided with resiliently deformable struts for each side, attached at one end to a beam, fixed to the mast of the sailing device, the mast being rotatable about its vertical axis in either direction relative to vertical planes along the longitudinal axes of the sailing device and the boom in a manner whereby a cam action is produced by the beam to deform or bend the struts in a manner so as to vary the camber of the wing sail, the amount of camber of one side of the wing sail being greater than the concave curvature of the opposed side thus producing an airfoil configuration. Provisions are made to permit translation of the two main surfaces of the wing sail as well as the surfaces at the clew corner while maintaining proper tension in the surfaces, and an aerodynamic seal is provided along the trailing edge of the wing sail. A horizontal control bar is attached to the mast to control the pivotal movement of the mast by a block and tackle attached between each end of the bar and the boom.

17 Claims, 12 Drawing Figures

VARIABLE CAMBER WING SAIL

Field of the Invention

The present invention pertains to a variable camber wing sail structure to improve the efficiency and performance of an aerodynamic lift structure for use on sailing devices.

OBJECTS OF THE PRESENT INVENTION

One of the principal objects of the present invention is to provide a variable camber sail member with resiliently deformable struts attached at one end in a cantilever manner to a beam, fixed vertically along the mast of a sailing device and extending horizontally to points of attachment to the trailing edge of the sail, the mast being rotatable about its vertical axis in either direction relative to the boom and the longitudinal axis of the sailing device whereby a cam action is produced by the beam to deform or bend the struts in a manner so as to vary the camber of the wing sail.

Another principal object of the invention is to provide a second sail member in a spaced-apart overlying relation to the first sail member with like deformable struts attached at one end in cantilever manner to an opposed side of the vertical beam and extending horizontally to points of attachment to the trailing edge of the second sail member to define, along with the first sail member, a two-sided wing sail.

A further object of the instant invention is to provide hook means connecting between respective pairs of deformable struts of the first and second sail members to permit translation of the surfaces of the first and second sail members when the two-sided wing sail is adjusted by rotation of the mast.

Yet another object of the present invention is to provide a diaphragm in a connecting relation between the trailing edges of the first and second sail members to permit the aforementioned translation while effecting a seal between said trailing edges.

A still further object of the invention is to provide a mast rotation control means comprised generally of a horizontal bar rigidly attached to the mast and a block and tackle means attached between the respective ends of the bar and the boom.

Another object of the present invention is to provide means in the clew corner of the sail assembly of translating the bottom side edges of the first and second sail members relative to each other as well as each relative to a single boom in a coordinated manner.

DETAILED DESCRIPTION OF THE INVENTION

Figure 1:
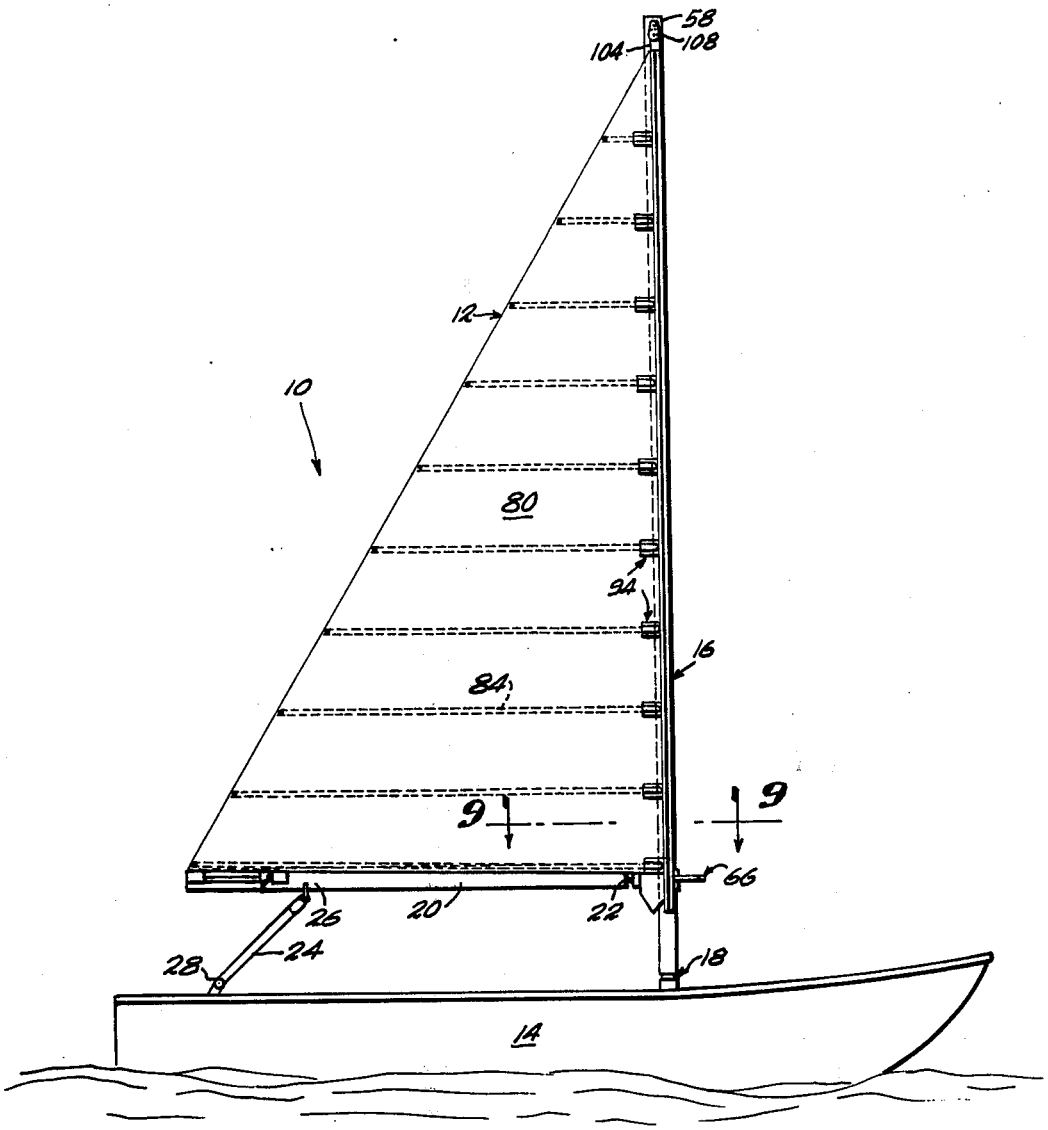
FIG. 1 is a side elevational view of a sailboat incorporating the variable camber wing sail of the present invention.

With reference to the drawings in which like reference characters designate like or corresponding parts throughout the various views and with particular reference to FIG. 1, the numeral 10 generally designates a sailboat incorporating the variable camber sail assembly 12 of the present invention. The sailboat may be comprised of any one of a variety of hull designs such as 14 with a generally vertically extending mast assembly 16, rotatably mounted on its vertical axis at 18 relative to hull 14. A boom 20 is pivotally attached in any convenient manner at 22 to the mast assembly 16 in a generally conventional position and relation thereto. The pivotal position of the boom 20 is controlled by block and tackle means 24 connecting between the aft end portion 26 of boom 20 and the stern portion of the sailboat as at 28 in a conventional manner.

Figure 2:
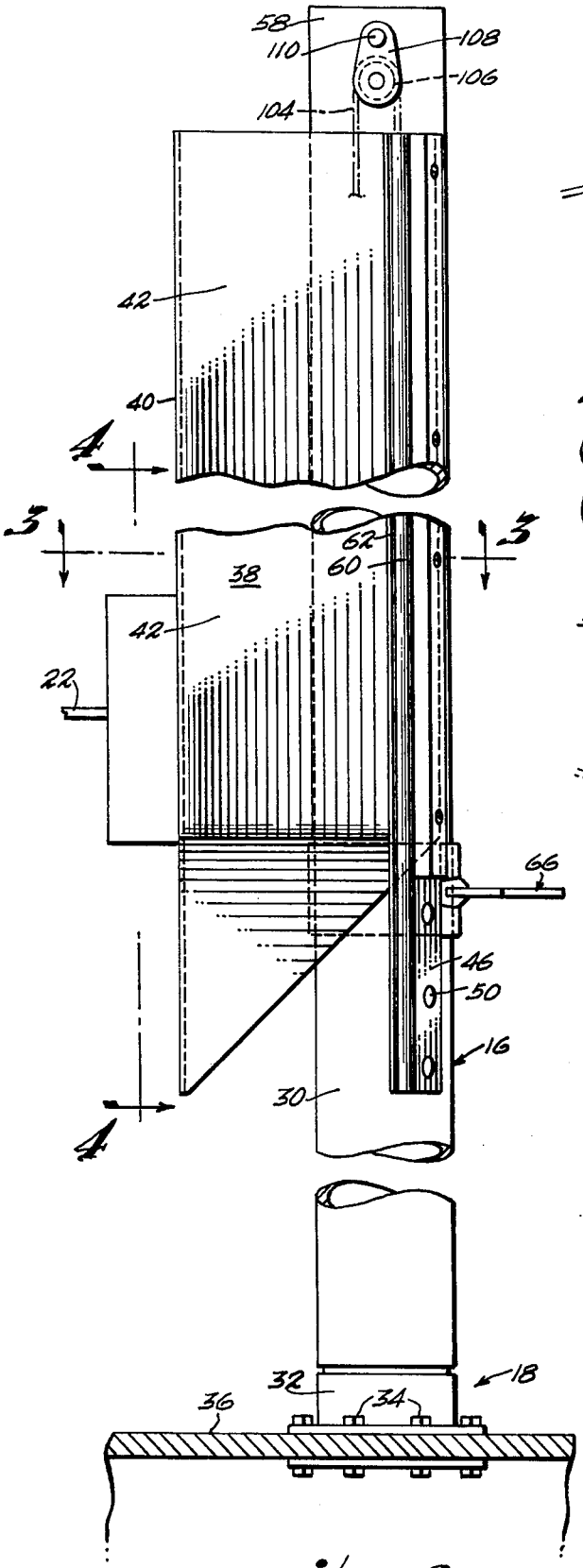
FIG. 2 is an enlarged, fragmentary, elevational view of the mast structure of the sailboat of FIG. 1.
Figure 3:
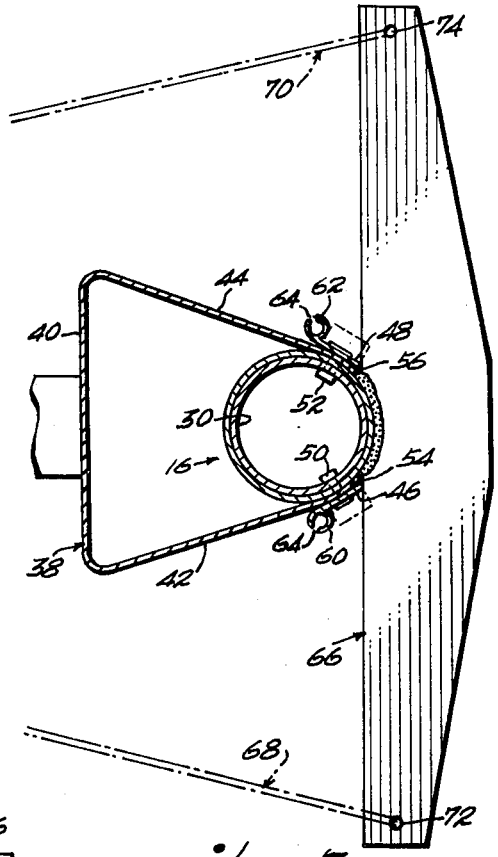
FIG. 3 is a horizontal cross sectional view taken along line 3—3 of FIG. 2.
Figure 4:
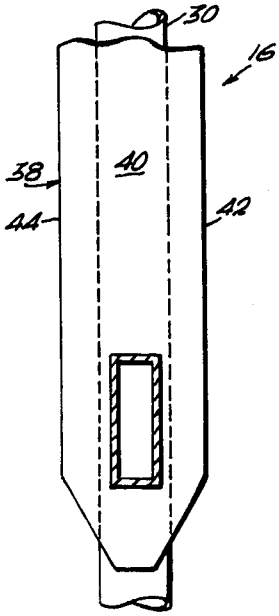
FIG. 4 is a vertical cross sectional view taken along line 4—4 of FIG. 2.

With particular reference to FIGS. 2, 3 and 4, the mast assembly 16 includes a vertically extending element such as the tubular mast member 30 which is rotatably carried on its vertical axis in a receptacle 32 which is bolted at 34 or otherwise affixed to a support structure 36 of the hull 14. Also included in mast assembly 16 is a vertically extending beam 38 which is generally U-shaped in cross sectional configuration, and is comprised of a trailing face wall 40 and a pair of opposed outwardly extending diverging side walls 42 and 44.

A pair of opposed side strips 46 and 48 are fixed as by pluralities of rivets 50 and 52 along with forwardly extending edge portions 54 and 56 of the side webs 42 and 44 of beam 38 to the tubular mast 30. As seen in FIGS. 1 and 2, the beam 38 and strips 46 and 48 extend from positions somewhat below the boom 20 to a position somewhat short of the top end 58 of mast 30. Opposed side strips 46 and 48 include vertically extending tubular rear edge portions 60 and 62, each of which is vertically slotted at 64 along its length for a purpose to be hereinafter described.

Figure 9:
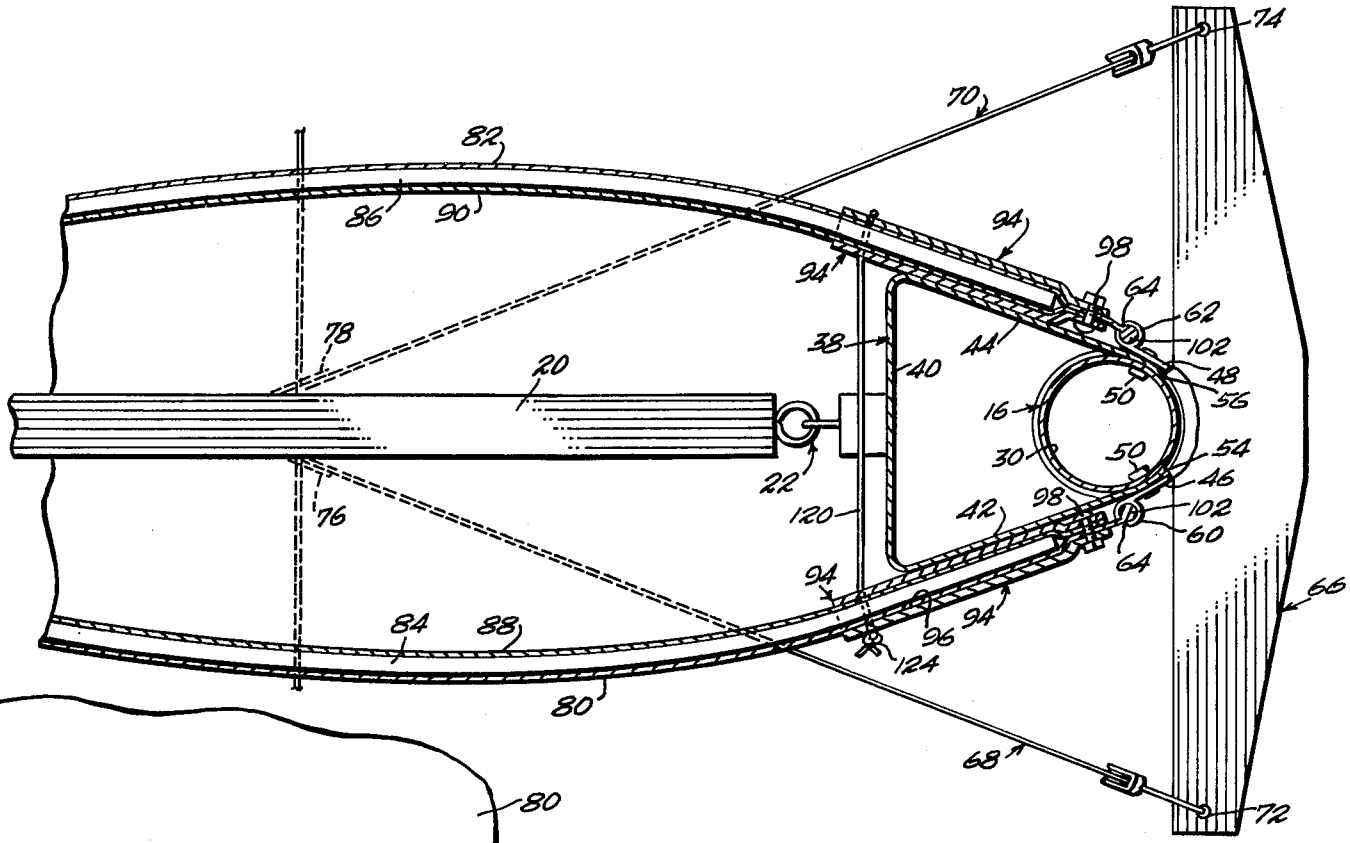
FIG. 9 is an enlarged horizontal cross sectional view taken along line 9—9 of FIG. 1.

Referring to FIGS. 2, 3 and 9 a horizontal bar 66 is rigidly attached to the tubular mast 30. Bar 66 comprises a mast rotation control means for the mast assembly 16. A pair of block and tackle means 68 and 70 are connected between holes 72 and 74 in opposed end portions of bar 66 and boom 20 as at 76 and 78 for rotational operation and control of the mast assembly 16 relative to boom 20.

Figure 5:
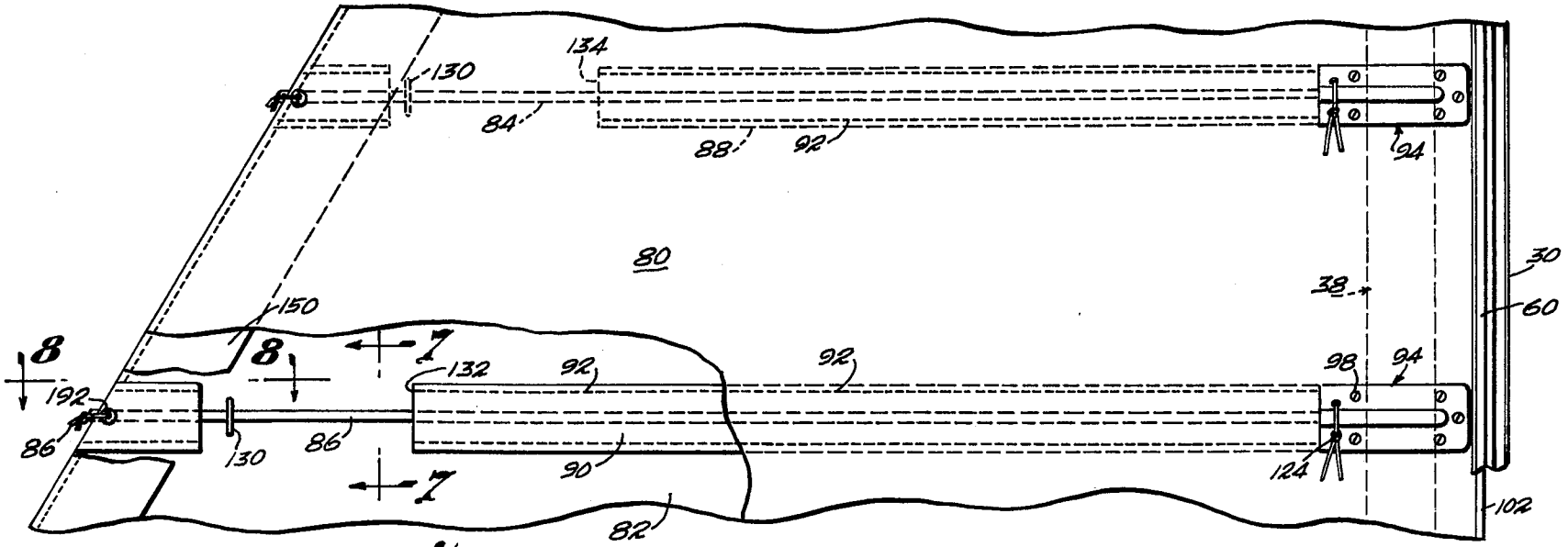
FIG. 5 is an enlarged, fragmentary elevational view of the wing sail assembly with parts broken away to illustrate details of its construction.
Figure 10:
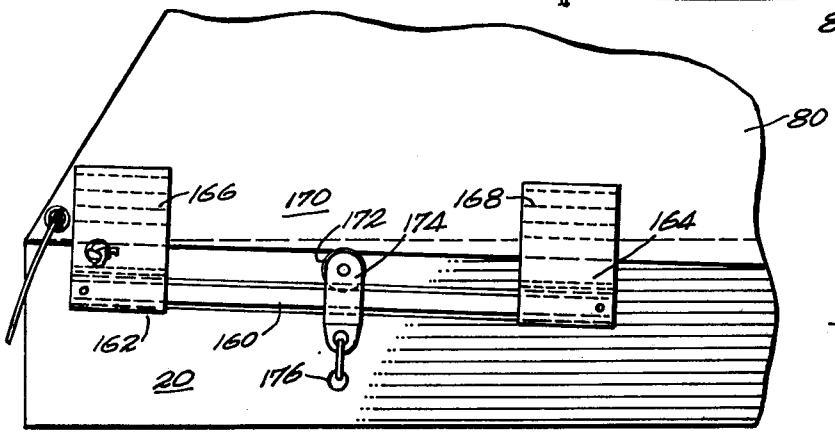
FIG. 10 is an enlarged elevational view of the clew corner of the sail as seen in FIG. 1.

Referring particularly to FIGS. 1, 5 and 10, the variable camber sail assembly 12 includes two generally alike sail members 80 and 82, provided with pluralities of resiliently deformable struts 84 and 86 in spaced apart, longitudinally extending, generally parallel relationships. The struts 84 and 86 are confined in pockets 88 and 90, fixed to the inner sides of the respective sail members 80 and 82 by stitching 92.

Figure 6:
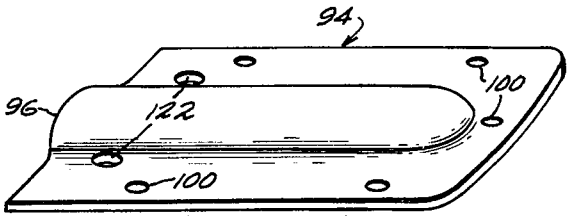
FIG. 6 is a perspective veiw of one of the clamp members utilized for holding the resiliently deformable struts relative to the leading edge of the sail members.

At their forward ends, each strut 84 and 86 is fixed in place between a pair of clamp members 94, one of which is detailed in FIG. 6. Each pair of clamp members 94 is disposed against opposite surfaces of the forward portion of one of the sail elements 80 and 82 with a forward end portion of one strut 84 or 86 confined in a tubular recess defined by mating half round depressions 96 formed along the major portion of the central length of each clamp member 94. Nut and bolt means 98 are secured relative to pluralities of pairs of aligned holes 100 in clamp members 94, with the sail material therebetween, to clamp the strut ends to the forward edge portions of sail member 80 and 82.

Each sail member 80 and 82 provides a bead 102 along the length of its forward edge for sliding engagement through a tubular edge portion 60 or 62 with the sail material extending rearwardly through slot 64 therein. Each sail element 80 and 82 is hoisted and lowered by halyards, fragmentarily illustrated in broken lines 104 in FIG. 2, fixed to a bead 102 and passed around a pulley 106 of block 108, fixed at 110 to the top portion 58 of tubular mast 30. As illustrated in FIG. 9, a line 120 is drawn tightly across in a spanning relation to the two sail members 80 and 82 at each clamp location. Each line 120 is passed through hole means 122 in opposed pairs of clamp members 94 of the sail members 80 and 82 and tied off as at 124. The forward ends of sails 80 and 82 tend to diverge rearwardly under the influence of struts 84 and 86 in the neutral position of FIG. 9.

Figure 8:
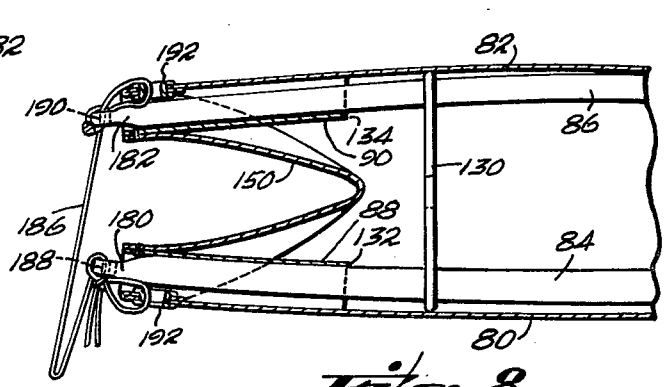
FIG. 8 is an enlarged horizontal cross sectional view taken along line 8—8 of FIG. 5.
Figure 7:
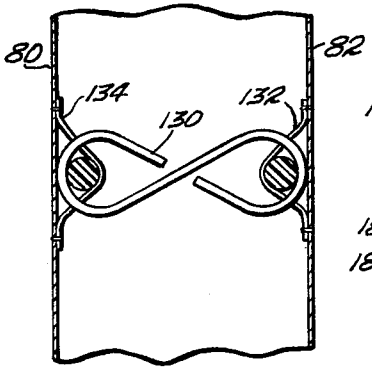
FIG. 7 is an enlarged vertical cross sectional view taken along line 7—7 of FIG. 5.

Referring to FIGS. 7 and 8, the spacing between the trailing end portions of each aligned pair of struts 84 and 86 is confined to a distance substantially less than the distance between the diverging forward ends thereof by an S hook 130 slidably engaged around struts 84 and 86 through confronting slots 132 and 134 in pockets 88 and 90 adjacent the rear ends thereof. Discounting wind forces, in a neutral position with the rotational control bar 66 at right angles to the boom 20, both sails 80 and 82 will assume like convex configurations as in FIG. 11. The S hook 130 comprises a suitable means to interconnect the bottom or struts 84 and 86; however, loop types may be used or other suitable means which permit a limited range of relative movement of translation which maintain interconnection of the two.

Figure 12:
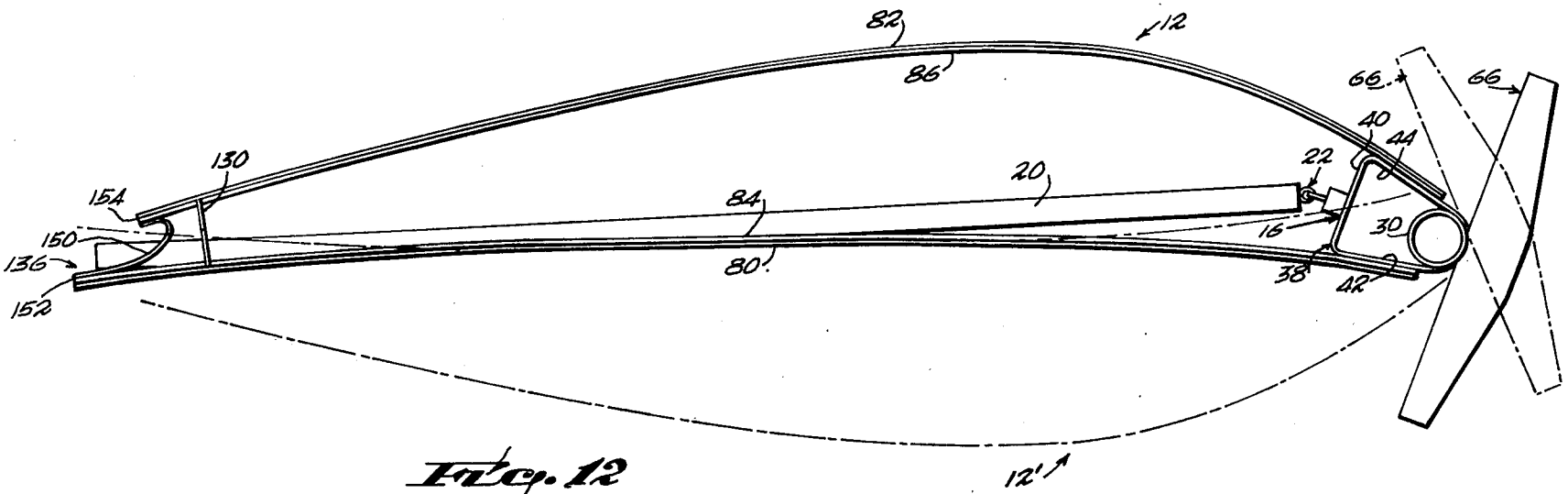

When the control bar 66 is moved to the full line, angled position relative to boom 20 of FIG. 12, the convexity or camber of sail member 82 will be substantially increased under the influence of struts 86 while the sail member 80 will assume the concave configuration, generally as illustrated. The sail assembly 12, therefore, defines an airfoil configuration similar to that of a fixed airplane wing, however, the camber of sail assembly 12 may be varied by proper rotational movement of the mast 30 by means of control bar 66, or, as illustrated in broken line 12' in FIG. 12, the camber may be reversed. The boom 20 may be controlled to any desired position in a conventional manner and the sail assembly 12, as above described, may be controlled relative to boom 20 to obtain a maximum degree of efficiency therefrom. FIG. 12 also illustrates generally at 136 how the surfaces of sail members 80 and 82 are permitted to translate relative to each other by means of the slidable S hooks 130 to define a natural airfoil configuration as opposed to a deformed airfoil configuration resulting from the trailing edges of sail members 80 and 82 being interconnected or otherwise being restrained against said translational movement.

A further feature of the sail assembly 12 is the aerodynamic seal in the form of a flexible diaphragm 150 connecting between the lengths of the trailing edges 152 and 154 of sail members 80 and 82. The diaphragm 150 is preferably formed by sewing an ample width of sailcloth or other suitable flexible material between the lengths of the trailing edges 152 and 154, thereby permitting the translation of said edges while preventing a secondary airflow from entering the sail assembly 12 between said trailing edges.

As detailed in FIG. 10, means are provided to permit the free translating movement of the clew corner portion of sail members 80 and 82 relative to each other as well as to a single boom 20. This is accomplished by fixing a generally horizontally extending rod 160 in a spanning relation to a pair of pockets 162 and 164 sewed at 166 and 168 in a spaced apart relation to the foot of each clew corner such as 170. The sheave 172 of a block 174 is positioned for rolling engagement along the top surface of rod 160 and the block 174 is rigidly connected at 176 to boom 20 beneath rod 160. In this manner, vertical tension may be applied to both sail members 80 and 82 through a single boom 20 while permitting the aforementioned translating movement of the entire surfaces of sail members 80 and 82 including the clew corner portions 170.

As seen in FIGS. 5 and 8, the trailing edges 180 and 182 of each pair of struts 84 and 86 may be loosely connected by a line 186 which is loosely secured through holes 188 and 190 in the trailing strut ends 180 and 182 and through gromets 192 fixed in the trailing sail edges. The lines 186 are of sufficient lengths so as not to interfere with the translating movements of the sail surfaces.

Figure 11:
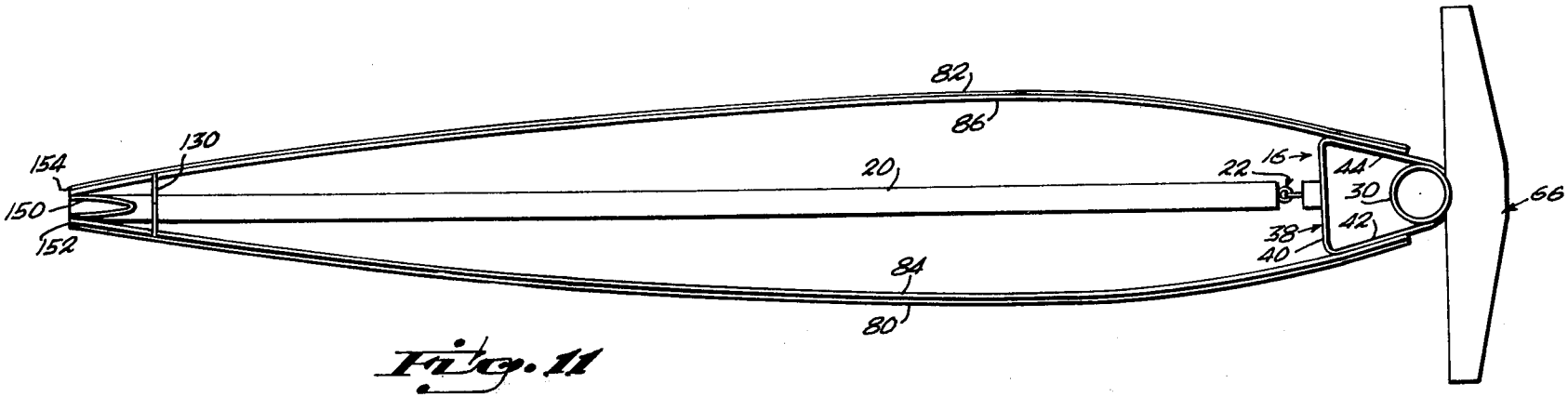
FIGS. 11 and 12 are schematic views illustrating the operation of the variable camber wing sail of the present invention.

In a more simple form, the wing sail 12 of the present invention may be comprised of a single sail assembly such as 82 in FIGS. 11 and 12 with the resiliently deformable struts 86. In this form a projection such as the side wall 44 of vertical beam 38 could replace the beam 38 and any convenient expedient may be employed to maintain the forward edge portion of the sail 82 in engagement with the projection 44. The clew corner of the single sail would be tensioned relative to mast 30 while permitting translation thereof relative to boom 20 in the same manner as described relative to FIG. 10.

It will be seen that the cam action of the rotatable mast on the bottoms induces a torque or movement into the struts or bottoms which causes them to assume aerodynamic contours of both the pressure surface and suction surface, which are, respectively, seen in FIG. 12 and designated by the numerals 80 and 82. Further, in use with a conventional single sided sail, it is also possible to use cam action on the bottoms to affect their bend contour and, therefore, determine an aerodynamic contour for the sail.

What is claimed is:

1. A variable camber wing sail and a sailing device including a mast assembly with a lower end, a mast support structure and a boom pivotally connected generally at right angles to the mast assembly adjacent the lower end comprising:

means to mount the mast for rotational movement about its vertical axis to said support structure of the sailing device, said mast assembly including a main, generally vertically extending mast member and an outwardly extending projection comprising a vertically extending rigid beam along the major portion of the mast height, said beam including a trailing end portion, a sail member positioned relative to the rotatable mast assembly and boom including a main body portion, forward and trailing edges, and a clew corner portion, a plurality of resiliently deformable struts fixed relative to said sail member along a major portion of their lengths in a spaced apart, generally horizontal, parallel relation, each of said struts including forward and trailing end portions and extending between said forward and trailing sail edges, means to support said sail member with said struts in a hoisted position relative to said rotatable mast assembly and boom with said sail forward edges and said struts forward end portions engaging said mast assembly and overlying said outwardly extending projection along the mast height, the main lengths of said struts extending outwardly from said mast assembly in cantilever fashion, said sail member and plurality of struts comprising a first sail assembly, and including a second sail assembly with means to support it in a hoisted position relative to said rotatable mast assembly and boom in a spaced apart relation to said first sail assembly, said second sail assembly including a sail member having a main body portion, forward and trailing edges and a clew corner portion, and a second plurality of resiliently deformable struts, fixed to said second sail member, conforming in all respects to said plurality of said first sail assembly struts, connection means between said clew corner portions and the boom to permit translation of said clew corner portions relative to the boom while maintaining proper tension forces in the sail between said boom and mast assembly, a mast assembly rotation control means, including opposed outwardly extending end portions, fixed to said mast, and block and tackle means connecting between said opposed end portions and said boom for selective rotational operation of said mast assembly in either direction to impart a cam action to the plurality of struts by said rigid beam trailing end portion to bend said struts to a degree in direct proportion to the amount of rotation of said mast assembly.

2. The variable camber wing sail as defined in claim 1 wherein said outwardly extending projection comprising said (a) beam fixed to said main mast member is generally U-shaped in horizontal cross section, including a pair of opposed outwardly extending diverging side walls, with inner and outer ends spanned at their respective outer ends by a trailing face wall comprising said trailing end portion and means connecting the inner ends of said side walls fixedly to said main mast member.

3. The variable camber wing sail as defined in claim 2 wherein first and second generally vertical, parallel corners are defined by said outer ends and trailing face wall, said first corner engaging a forward end portion of said first sail assembly and said second corner engaging a forward end portion of said second sail assembly, the main lengths of said first and second sail assembly forward end portions being in an overlying relation respectively with said pair of outwardly extending diverging side walls.

4. The variable camber wing sail as defined in claim 3 wherein each of said pluralities of struts of said first and second sail assemblies is enclosed in a longitudinally extending pocket of a suitable flexible material fixed as by sewing along the inside surface of one of the sails of said first and second sail assemblies, each of said pluralities of struts being of the same number and said pockets being positioned in aligned confronting pairs on the inside surfaces of the respective sail members of said first and second sail assemblies.

5. The variable camber wing sail as defined in claim 4 including hook means connecting between each pair of said struts through elongated slots in each of said confronting pairs of pockets adjacent the trailing ends of the sails of each of said first and second sail assemblies, each of said hook means being sized to position the trailing end portions of said first and second sail assemblies in a substantially closer relation than the spacing therebetween at said forward end portions thereof as defined by said trailing face wall.

6. The variable camber wing sail as defined in claim 5 wherein said hook means comprises an S hook.

7. The variable camber wing sail as defined in claim 4 including a seal means fixed in a closing relation along the lengths of said trailing edges of the pair of sails of said first and second sail assemblies.

8. The variable camber wing sail as defined in claim 7 wherein said seal means comprises a diaphragm.

9. The variable camber wing sail as defined in claim 8 wherein said diaphragm is formed of a suitable flexible material such as sailcloth, fixed as by sewing between said sail trailing edges, said diaphragm being of such a width so as to provide a sufficient degree of fullness between said sail trailing edges to permit free translation of said sail trailing edges and the surfaces of the pair of sails relative to each other when said mast assembly is rotated.

10. The variable camber wing sail as defined in claim 3 including connection means between said first and second sail assemblies outwardly of and adjacent to said trailing face wall.

11. The variable camber wing sail as defined in claim 10 including a pair of mating clamp members disposed against opposite surfaces of said forward portion of each of said sail members at the location of each of said strut forward end portions, said pair of mating clamp members providing a tubular recess, defined by mating half round depressions formed along the major portion of the central lengths thereof to receive said forward end portion of one of said struts, said mating pair being provided with a plurality of aligned holes for the reception of nut and bolt means to fix said mating pair in a clamping engagement with said strut forward end portion and the material of said sail member.

12. The variable camber wing sail as defined in claim 11 wherein said connection means between said first and second sail assemblies comprises a line drawn tautly across in a spanning relation to said two sail members of said first and second sail assemblies at each pair of clamp locations as defined by a pair of said strut forward end portions relative to the respective sail members, each pair of said mating clamp members including hole means for the passage therethrough of said line whereby said line may be secured in any convenient manner such as by tying.

13. The variable camber wing sail as defined in claim 1 wherein said connection means between said clew corner portion and the boom comprises a first clew corner connection means and including a second clew corner connection means between the boom and said clew corner of said second sail assembly.

14. The variable camber wing sail as defined in claim 13 wherein each of said clew corner connection means comprises a generally horizontally extending rod fixed in a spanning relation to a pair of spaced apart pockets fixed as by sewing to a foot of each of said clew corners, a block including a sheave is provided in a fixed relation to each side of the boom beneath said rod with said rod extending through said block whereby said sheave is positioned for rolling engagement along the top surface of said rod.

15. The variable camber wing sail as defined in claim 1 wherein said means to support said first and second sail assemblies comprises a block and halyard assembly for each of said sail assemblies, each of said blocks being fixed relative to the top end portion of said main mast member and a sheave of said block being traversed by said halyard having a first end fixed relative to the forward edge of said sail assembly, said halyard extending downward to a second end for manual manipulation for hoisting, lowering and supporting said sail assembly in a hoisted attitude in a conventional manner.

16. The variable camber wing sail as defined in claim 15 wherein each of said sails of said first and second sail assembly includes a bead along the length of its forward edge, and including a pair of spaced apart side strips fixed vertically along the major length of said mast assembly, each of said side strips including a tubular edge portion sized to slidably receive said bead of one of said sails, and being vertically slotted along its length for passage therethrough of the sail material extending outwardly from said bead.

17. The variable camber wing sail as defined in claim 1 wherein said mast assembly rotation control means comprises a horizontally extending bar including said end portions provided with connection means for said pair of block and tackle means.

* * * * *